United States Patent [19]

Kohler

[11] 3,952,553

[45] Apr. 27, 1976

[54] STOPPING APPARATUS FOR A RECTILINEAR KNITTING MACHINE

[75] Inventor: Fritz Kohler, Couvet, Switzerland

[73] Assignee: Edouard Dubied et Cie (Societe Anonyme), Couvet, Switzerland

[22] Filed: Mar. 21, 1975

[21] Appl. No.: 560,968

[30] Foreign Application Priority Data

Mar. 27, 1974 Switzerland ..... 4262/74

[52] U.S. Cl. ..... 66/157; 66/64

[51] Int. Cl.[2] ..... D04B 35/10

[58] Field of Search ..... 66/60, 64, 157

[56] References Cited

UNITED STATES PATENTS

| | | | |
|---|---|---|---|
| 3,049,900 | 8/1962 | Bram | 66/60 |
| 3,153,922 | 10/1964 | Bram | 66/64 |
| 3,613,401 | 10/1971 | Jeffcoat et al. | 66/60 |
| 3,685,317 | 8/1972 | Giachetti et al. | 68/64 |
| 3,839,884 | 10/1974 | Flavell et al. | 66/64 |
| 3,842,623 | 10/1974 | Flavell et al. | 66/64 |

*Primary Examiner*—Ronald Feldbaum
*Attorney, Agent, or Firm*—Hume, Clement, Brinks, Willian, Olds & Cook, Ltd.

[57] ABSTRACT

A stopping apparatus for a rectilinear knitting machine comprising at least two needlebed parts arranged in roof form and provided with needles, a carriage being displaced in an oscillating movement above the frame parts for the control of the needles during its displacement in alternating directions, and at least one apparatus forming one piece with said knitting carriage to move the fabric away from the knitting area of the needles, said stopping means comprising a switch feed means arranged parallel with the direction of movement of the knitting carriage and control means for this switch.

2 Claims, 2 Drawing Figures

STOPPING APPARATUS FOR A RECTILINEAR KNITTING MACHINE

The present invention relates to a stopping apparatus for a rectilinear knitting machine comprising at least two needlebed parts arranged in roof form and provided with needles, a carriage being displaced in an oscillating movement above the frame parts for the control of the needles during its displacement in alternating directions, and at least one apparatus forming one piece with said knitting carriage to move the fabric away from the knitting area of the needles, said stopping means comprising a switch feed means arranged parallel with the direction of movement of the knitting carriage and control means for this switch.

In a rectilinear knitting machine whose needles are controlled by locks fastened on the carriage and capable of controlling said needles in the oscillating movements of the carriage it is known to fasten a stopping means directly on the carriage.

The known solutions, for example a finger and a lever passing between the rows of needles of two parallel frame parts and just above the fabric being suspended in the hooks of said needles have proved to be satisfactory. The displacement of a finger or lever in relation to its reference position caused, by appropriate and known means, the stopping of the knitting machine, that is it stopped the carriage in its travel if a needle was not brought down or if a jamming occurred on the fabric to be knit.

The development of rectilinear knitting machines led the designer to installing on his machines devices generally called "stitch pressing devices".

The position of these stitch pressing devices on the carriage of knitting machines and the fact that they are displaced between both frame parts and on the fabric to be knit, suspended at the needles, does not permit the use of the stopping devices known from the prior art.

The objective of the invention is to create a simple stopping device which easily can be adapted to a rectilinear knitting machine provided with a stitch pressing device. This device should not hamper the adjustment requirements of a stitch pressing device and must be easily dismantable or concealable to allow access to the vital parts of a stitch press.

The stopping device, according to the invention, is characterized by forming one piece with a support concealable about an axis which in turn forms one piece with an apparatus separating the fabric from the operating field of the needles, because the control means of the switch are adjustable by adjustment means forming one piece with members capable of being displaced perpendicularly to the operating direction of the carriage during a malfunctioning of the knitting machine.

The control means of the stopping device preferably are constituted directly by the stitch presses.

The attached drawing exemplifies an embodiment of the stopping device for a knitting machine, the subject matter of the invention.

Figures 1, 2:
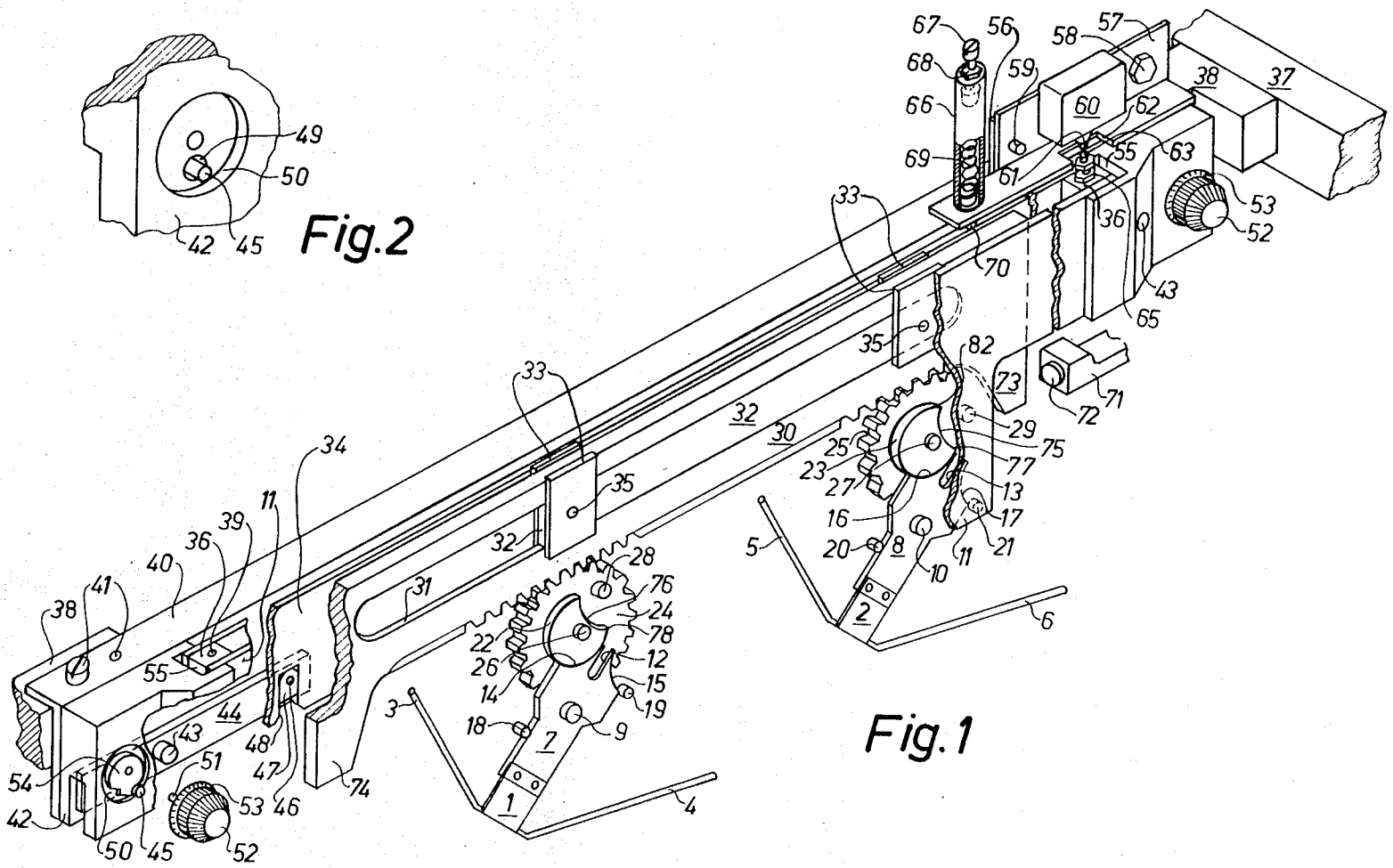
FIG. 1 is a partial isometric projection where certain parts have been removed and others are shown blown up.
FIG. 2 is a partial isometric projection of a detail of FIG. 1.

The stitch presses 1 and 2 each include two slide blocks 3 and 4 and 5 and 6 respectively and each is fastened to a lever 7 and 8 respectively. The means of fixing the slide blocks on the stitch presses and of the stitch presses on the levers 7, 8 are known and will not be described more in detail within the scope of this application. The lever 7 and lever 8, respectively, are mounted pivotably on a shaft 9 and/or 10, forming one piece with a front plate 11 partly shown in this figure. The end of this lever 7 and 8 respectively which is most proximal to the shafts 9 and/or 10 for the pivoting is machined in the form of a Malta cross or more exactly in the form of only part of the usually known Malta cross. This Malta cross part comprises a groove 12 and 13 respectively and disengagements 14, 15 and/or 16, 17. The levers 7 and 8 respectively can pivot about their respective axis 9 and 10 respectively within limits formed by the stops 18, 19 and/or 20, 21, forming one piece with the front plate 11, on the one hand and by the conjugation of the disengagement forms 14, 15 and/or 16, 17 with the bearing surface 22 and/or 23 of the serrated wheel 24 and 25 respectively, pivoting about a shaft 26 and/or 27, forming one piece with the front plate 11 on the other hand. The serrated wheels 24 and/or 25 also have fixed lugs 28 and/or 29 and engage with a rack 30. The rack 30 has an aperture 31, slides on the guide 32, and is guided radially by the flanges 33. The flanges 33 and the guide 32 form one piece with a dorsal plate 34 by fixation means 35.

The front plate 11 and the dorsal plate 34 are separated and form one piece with either one of the cross-pieces 36 and fixation means not shown.

The assembly of these two plates (11, 34) and of all parts described so far will hereinafter be called in this specification the mobile unit of the device.

The apparatus is fixed on the stirrups 37, partly shown and already known, of a knitting carriage, itself not shown, by supporting means 38 and fixing means not shown. A longitudinal support 40 is fastened to the supports 38 by fixing means 41. It connects the supports 38 fastened to each stirrup 37 of the carriage and constitutes the basis of the apparatus.

A fork 42 is fastened to each end of the longitudinal support 40 by fixation means not shown. A lever 44 pivots on a shaft 43, forming one piece with said fork 42. A lug 45 is fastened to the end of this lever 44 which is most proximal to the shaft 43 and a shaft 46 is fastened to the other end on which a nut or sheave 47 can pivot freely; said nut 47 having space in an aperture 48 of the dorsal plate 34. The lug 45 of the lever 44 emerges via a hole 49 (FIG. 2) into a disengagement 50 of the fork 42.

A button 52 and a slide 53, shown blown up in FIG. 1, are mounted on a shaft 51 located in the center of the disengagement 50 and forming one piece with the fork 42.

The slide 53 freely pivots about the shaft 51 and has a cam 54. Said cam 54 forming one piece with the slide acts by its shape during the rotation of the slide 53 on the lug 45 which has the effect that the lever 44 is caused to pivot about its shaft 43. The button 52 is used to block the cam 54 and thus the slide 53 in a selected position. Its operation is known and thus will neither be shown nor described within the scope of this application.

The mobile unit of this apparatus, described before, is placed in suspension on the nuts or sheaves 47 in the aperture 48 of the forks 42.

A support 57 pivoting about the shaft 58 forming one piece with the support 56 is mounted on the support 56 which is fastened on the longitudinal support 40 by fixation means, not shown, on either side of the apparatus. The support 57 is positioned in relation to the support 56 by means of a removable peg 59.

The electrical switch 60 forms one piece with the support 56 and its contact 61 forms in this respect by the opening 62 of the support 57, opposite a stop 63 one piece with the crosspiece 36. This stop is vertically adjustable (stop 63) and positionable by the locknut 65.

A compensation system 66, consisting of an adjustment screw 67, a blocking nut 68, a spring 69, a sensor 70, forms one piece with the support 57. The sensor 70 presses on the dorsal plate 34 of the mobile unit.

The partially shown stop 71 forms one piece with the machine frame (not shown) and has a pellet 72 allowing for the deadening of the noise when the stop 73 of the rack 30 strikes against this stop 71.

To facilitate the comprehension of the drawing, certain parts of the apparatus are shown only at one end of the apparatus. However, it should be understood that a similar arrangement is placed at the other end of the knitting machine and of the apparatus. For example, a stop 71 exists at the other end of the knitting machine which coacts with the stop 74 of the rack 30. The same applies to the compensation system 66, the electrical switch 60 and the lever system 44 with its nut 47 being fastened to each end of the apparatus.

The operation of the stitch press and the position of the slide blocks of the stitch presses in relation to the needles of a rectilinear or straight line knitting machine is described in the German patent (German application, publication copy No. P 19 561 90.1) and will not be described in greater detail within the scope of this application.

FIG. 1 shows the position of the stitch press device (1, 2) at the moment when the carriage has started its movement from right to left seen from the operator's station.

As the carriage arrives at the left of the knitting machine, outside the field of the needles, the carriage starts its deceleration in a manner known and not described here.

The stop 74 hits against the stop 71 (not shown on the left) and maintains the rack 30 immobile in relation to the frame of the knitting machine (not shown). The carriage continues its travel, so that the rack 30 slides on the guide 32. The front plate 11 which indirectly forms one piece with the carriage is moved in relation to the rack 30 so that the serrated wheels 24 and 25 respectively held by their engagement with said rack will rotate around shafts 26 and 27 respectively, which form one piece with the front plate 11. If the carriage is moved from right to left the serrated wheels 24, 25 rotate clockwise.

The angular displacement of said dented wheels permits, in this position, the lug 29 to enter the groove 13 of the lever 8 before the lug 28 enters the groove 12 of the lever 7. This angular displacement makes it possible to prevent the slide blocks 4 and 5 from colliding during the rotation of the stitch presses. During the movement of the carriage in the opposite direction, that is from left to right, the lever 7 pivots about its shaft 9 before the lever 8 pivots about its shaft 10 to prevent the slide blocks 4 and 5 from colliding.

In the case we are describing here, that is movement from right to left, the lug 29 moves the lever 8 about its shaft 10 as soon as the stop 77 of the bearing surface 23 has exceeded a line connecting the shafts 10 and 27, the disengagement 75 permitting the free passage of the end of lever 8.

During the rotation of the lever 8, the lug 28 moves the lever 7 about its shaft 9 as soon as the stop 77 of the bearing surface 22 has exceeded a line connecting the shafts 9 and 26, the disengagement 76 permitting free passage of the end of the lever 7. As soon as the stop 82 of the bearing surface 23 has cleared the line connecting shafts 10 and 27, the lever 8 is no longer displaced by the lug 29 and it arrives against the stop 21. The disengagement 17 allows the wheel 25 to continue to rotate and the conjugation of the forms of the bearing surface 23 and of the disengagement 17 form the bolting of the lever 8. To avoid too high a machining precision of the bearing surface 23 and of the disengagement 17, the diameter of the stop 21 will be adjusted once and for all during the assembly of the apparatus, to compensate for the play which might exist between the bearing surface 23 and the lever 8. The same applies to the stops 18, 19 and 20.

The pivoting of the lever 7 is effected in the same manner as that of the lever 8. Once both pivotings are completed, the linear speed of the carriage continues to decrease until zero and the carriage starts again in the opposite direction. The stitch presses 1 and 2 then are in working position.

The vertical adjustment of the position of the slide blocks 3 and 5 or 4 and 6, in relation to the needles, is accomplished by means of the slides 53 and the cam 54, located at each end of the apparatus.

The shock from one needle against the slide blocks 3 and 5 or 4 and 6 during the knitting raises the mobile unit, so that one of the two or both stops 63 located at each end of the apparatus (the one at the left is not shown) would be fixed in the hole 39 of the crosspiece 36. It urges the contact of the switch 60 which operates like a short circuit, causing by means known and not shown, the braking and stopping of the carriage. The feeding device of the switches by means of slides rubbing on a rail parallel with the movement of displacement of the carriage is likewise known and not shown.

The function of the compensation system 66 is to assure the position of the mobile unit on the nuts or sheaves 47 and permits adjustment by the screw 67, and the spring 69, of the force required to raise said mobile unit so that possible vibrations of the knitting machine cannot trigger the switch 60 too easily.

The disassembling of the mobile unit is easily accomplished by removing the removable pegs 59 and causing the support 57 to pivot about its axis 58. The mobile unit thus can be lifted and removed by hand.

The knitter thus is provided with a simple, easily dismantable apparatus providing him or her with a greater variety in the selection of the pieces to be knit on one automatic knitting machine.

What is claimed is:

1. A stopping apparatus for a rectilinear knitting machine comprising at least two needlebeds arranged in roof form and provided with needles, a carriage being displaced in an oscillating movement above the frame parts for the control of the needles during its displacement in alternating directions, and at least one apparatus forming one piece with said knitting carriage to move the fabric away from the knitting area of the needles, said stopping means comprising a switch, feed means arranged parallel with the direction of movement of the knitting carriage and control means for this switch, characterized by the fact that it forms one piece with a support concealable about an axis which in turn forms one piece with an apparatus separating the fabric from the operating field of the needles, and that the control means of the switch are adjustable by adjustment means forming one piece with members capable of being displaced perpendicularly to the operating direction of the carriage during a malfunctioning of the knitting machine.

2. A stop means according to claim 1 characterized by the control means being constituted essentially by stitch presses.

* * * * *